US008313091B2

(12) United States Patent
Moxley

(10) Patent No.: US 8,313,091 B2
(45) Date of Patent: Nov. 20, 2012

(54) MULTI-FUEL CARBURETORS AND RELATED METHODS

(75) Inventor: Ryan S. Moxley, Graham, NC (US)

(73) Assignee: Honda Motor Co., Ltd., Tokyo (JP)

( * ) Notice: Subject to any disclaimer, the term of this patent is extended or adjusted under 35 U.S.C. 154(b) by 712 days.

(21) Appl. No.: 12/418,219

(22) Filed: Apr. 3, 2009

(65) Prior Publication Data

US 2010/0252135 A1 Oct. 7, 2010

(51) Int. Cl.
*F02M 1/16* (2006.01)

(52) U.S. Cl. ..... 261/18.3; 261/22; 261/71

(58) Field of Classification Search ..... 261/18.1, 261/18.3, 22, 66–68, 71; 123/527
See application file for complete search history.

(56) References Cited

U.S. PATENT DOCUMENTS 871,134 A * 11/1907 Monnier et al. ..... 261/76
1,183,221 A * 5/1916 Miller et al. ..... 261/18.3
1,342,966 A 6/1920 McCutchan
2,059,334 A * 11/1936 Gustafsson ..... 123/575
2,323,639 A * 7/1943 Anderson ..... 123/543
2,930,432 A 3/1960 Engstrom
3,089,685 A * 5/1963 Hennemann et al. ..... 261/64.1
3,970,059 A * 7/1976 Pisar ..... 123/392
4,351,300 A * 9/1982 Selvidge et al. ..... 123/527
4,354,477 A * 10/1982 Sprick ..... 123/575
4,401,094 A * 8/1983 Shimmura et al. ..... 123/576
4,415,507 A * 11/1983 Voliva ..... 261/18.3
4,430,274 A * 2/1984 Suzuki et al. ..... 261/18.3
4,430,275 A * 2/1984 Horton ..... 261/18.3
4,433,664 A 2/1984 Rodrigues
4,440,697 A * 4/1984 Sakurai ..... 261/34.2
4,461,731 A * 7/1984 Herd et al. ..... 261/18.3
4,462,944 A * 7/1984 Sprick ..... 261/18.2
4,489,699 A 12/1984 Poehlman
4,499,887 A 2/1985 Billingsley et al.
4,518,540 A * 5/1985 Takayasu ..... 261/18.3
4,524,033 A 6/1985 Elledge
4,594,201 A 6/1986 Phillips et al.
5,667,730 A * 9/1997 Barfield ..... 261/18.3
5,676,117 A 10/1997 Williams
6,135,426 A 10/2000 Wargolet et al.
2008/0236552 A1 * 10/2008 Horikawa ..... 123/527

FOREIGN PATENT DOCUMENTS

DE 3639248 A1 * 5/1987

* cited by examiner

*Primary Examiner* — Richard L Chiesa
(74) *Attorney, Agent, or Firm* — Jenkins, Wilson, Taylor & Hunt, P.A.

(57) ABSTRACT

Multi-fuel carburetors and related methods are provided for a combustion engine. A multi-fuel carburetor can include at least two fuel nozzles for providing fuel from a fuel source to a carburetor barrel to produce a mixture of fuel and air. A fuel control device movable with respect to at least one of the fuel nozzles can be used to selectively adjust the amount of fuel that can be drawn through that nozzle, thereby desirably adjusting the air/fuel ratio of the mixture produced in the carburetor barrel.

18 Claims, 3 Drawing Sheets

MULTI-FUEL CARBURETORS AND RELATED METHODS

TECHNICAL FIELD

The subject matter disclosed herein relates generally to fuel control systems and methods for engines. More particularly, the subject matter disclosed herein relates to a fuel system that is adjustable to supply different fuels using a single carburetor.

BACKGROUND

Although gasoline is the predominant fuel used in many internal combustion engines, it is well known that such engines may be operated by any of a variety of different fuels. For instance, ethanol, methanol, butane, and others may also be used. In fact, with the increasing cost of hydrocarbon fuels (e.g., gasoline) and fluctuations in global supplies, the use of other fuels has received increased interest. However, since most internal combustion engines and their carburetors are designed for efficient use of gasoline, other fuels generally cannot be used effectively without changes to one or both of the engine itself or its carburetor. Such changes are necessary because each fuel operates on a particular air/fuel ratio (i.e., the stoichiometric mixture) for most efficient combustion.

For example, the stoichiometric air/fuel ratio of gasoline is about 14.6 units air to 1 unit of fuel. In contrast, the ratio for ethanol is about 9 to 1, and the ratio for methanol is about 6.5 to 1. Although many available fuel products are made up of mixtures of these materials (e.g., E20, E85), it is still apparent that the preferred operating conditions for using these different fuels in an internal combustion engine can vary greatly.

Accordingly, it would be advantageous for an internal combustion engine to be capable of operating using any of a variety of different fuels without requiring a dedicated carburetor for each fuel. Further, it would be favorable for the configuration of such an engine to be easily switched to provide the preferred operating conditions for the fuel being used.

SUMMARY

In accordance with this disclosure, devices and methods for adjusting the configuration of a carburetor are provided. In one aspect, a multi-fuel carburetor for a combustion engine is provided. The multi-fuel carburetor can include a fuel source, a carburetor barrel, first and second fuel nozzles, and a fuel control device movable with respect to the second fuel nozzle. The first fuel nozzle can have a first inlet at and communicating with the fuel source and a first outlet at and communicating with the carburetor barrel, and the second fuel nozzle can have a second inlet at and communicating with the fuel source and a second outlet at and communicating with the carburetor barrel. The fuel control device can be movable between a closed position in which the second fuel nozzle is blocked and an open position in which the second fuel nozzle is unobstructed.

In another aspect, a multi-fuel carburetor for a combustion engine can include a fuel source, a carburetor barrel, a first fuel nozzle, a second fuel nozzle, a fuel control device, and a control rod connected to the fuel control device. The first fuel nozzle can have a first inlet at and communicating with the fuel source and a first outlet at and communicating with the carburetor barrel, and the first fuel nozzle being sized to provide an amount of fuel to the carburetor barrel for producing an air/fuel ratio in the carburetor barrel for the combustion of a first fuel type. The second fuel nozzle can have a second inlet at and communicating with the fuel source and a second outlet at and communicating with the carburetor barrel, and the second fuel nozzle being sized such that the combination of the first fuel nozzle and the second fuel nozzle provide an amount of fuel to the carburetor barrel for producing an air/fuel ratio in the carburetor barrel for the combustion of a second fuel type. The fuel control device can be movable with respect to the second fuel nozzle, and the fuel control device can include a plate movable between a closed position in which the fuel inlet of second fuel nozzle is blocked and an open position in which the fuel inlet of second fuel nozzle is unobstructed. The control rod can be provided such that rotation of the control rod moves the plate between the closed position and the open position.

In another aspect, a method for providing fuel to a multi-fuel carburetor for a combustion engine can include supplying fuel from a fuel source through a first fuel nozzle and into a carburetor barrel, supplying fuel from the fuel source through a second fuel nozzle and into the carburetor barrel, and moving a fuel control device with respect to the second fuel nozzle between a closed position in which the second fuel nozzle is blocked and an open position in which the second fuel nozzle is unobstructed.

Aspects of the subject matter disclosed herein having been stated hereinabove, and which is achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
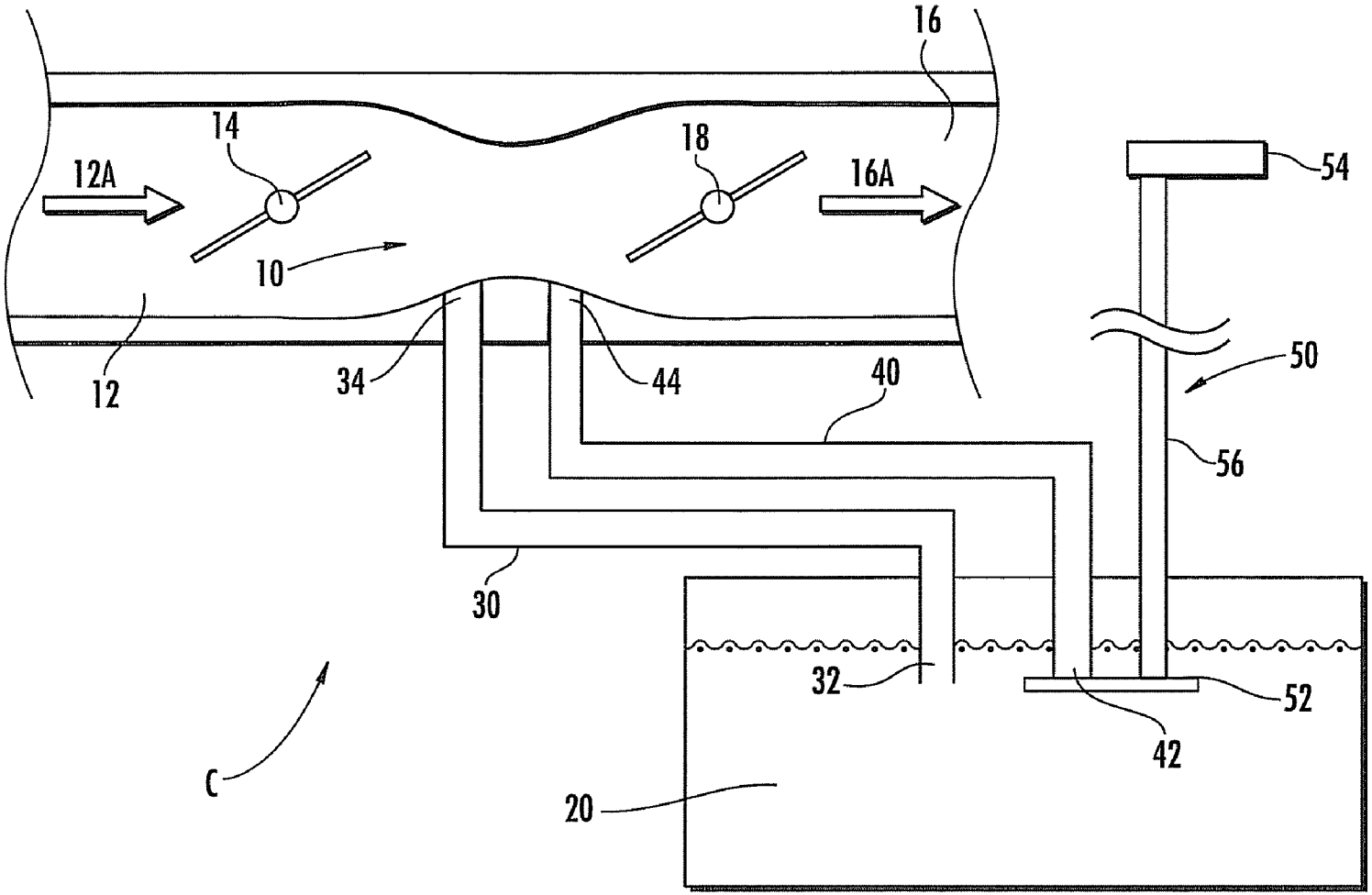
FIG. 1 is a diagrammatic view illustrating a multi-fuel carburetor according to an embodiment of the presently disclosed subject matter.

The present subject matter provides multi-fuel carburetors and related methods for an internal combustion engine. As is illustrated in FIG. 1, a carburetor in accordance with this disclosure, generally designated C, can include a carburetor barrel, generally designated 10, a fuel source 20, a first fuel nozzle 30, a second fuel nozzle 40, and a fuel control device, generally designated 50, which is movable with respect to second fuel nozzle 40. Generally, fuel can be drawn from fuel source 20 through one or both of first and second fuel nozzles 30 and 40 into carburetor barrel 10, where it can be mixed with air and supplied to the internal combustion engine.

Referring to FIG. 1, air can be received in carburetor barrel 10 through an air inlet 12, which can be regulated by a choke valve 14. In this arrangement, air can pass in the direction of arrow 12A. Fuel can be provided to carburetor barrel 10 from fuel source 20 through first and second fuel nozzles 30 and 40 and mixed with the air. Fuel source 20 can further include any of a variety of components known in the art to maintain an appropriate level of fuel in fuel source 20, including, but not limited to, a float connected to a fuel inlet valve and/or vent tubes to maintain atmospheric pressure in fuel source 20. The air-and-fuel mixture created can be sent through an outlet 16 in the direction of arrow 1 6A to the intake manifold of the engine. A throttle valve 18 can be provided in front of outlet 16 to control the flow of the fuel mixture through outlet 16.

Regarding the fuel nozzles, first fuel nozzle 30 can have a first inlet 32 in communication with fuel source 20 and a first outlet 34 in communication with carburetor barrel 10. First fuel nozzle 30 can be sized to provide an appropriate amount of fuel to carburetor barrel 10 for a first fuel type. In other words, first fuel nozzle 30 can be designed to provide an amount of fuel to carburetor barrel 10 to create the correct stoichiometric air/fuel ratio in carburetor barrel 10 for the combustion of the first fuel type. For example, if the first fuel type is gasoline, first fuel nozzle 30 can be sized to create the stoichiometric air/fuel ratio for gasoline (e.g., about 14.6 to 1) in carburetor barrel 10.

If fuel source 20 contains a fuel type requiring a richer fuel mixture for combustion, however, first fuel nozzle 30 alone can be insufficient to efficiently provide adequate fuel flow. Accordingly, second fuel nozzle 40 can be operated to provide an additional fuel flow from fuel source 20. In this regard, second fuel nozzle 40 can similarly have a second inlet 42 in communication with fuel source 20 and a second outlet 44 in communication with carburetor barrel 10. Second fuel nozzle 40 can be sized to provide, in combination with first fuel nozzle 30, an appropriate amount of fuel to carburetor barrel 10 for combustion of a second fuel type. Stated otherwise, the amount of fuel that can be provided to carburetor barrel 10 through second fuel nozzle 40 can supplement the amount of fuel provided by first fuel nozzle 30 such that the air/fuel ratio in carburetor barrel 10 is decreased so as to have the proper stoichiometric ratio for the second fuel type. For example, second fuel nozzle 40 can be sized such that the combined flow of fuel through first fuel nozzle 30 and through second fuel nozzle 40 provides an air/fuel ratio in the carburetor barrel 10 for the efficient combustion of a second fuel type, such as ethanol (e.g., E100).

In addition, if the operator desires to operate the engine using a fuel type having a preferred air/fuel ratio that lies somewhere between the stoichiometric ratios for the first fuel type (i.e., first fuel nozzle 30 alone) and the second fuel type (i.e., first and second fuel nozzles 30 and 40 combined), second inlet 42 can be at least partially obstructed to reduce the amount of fuel that is provided to carburetor barrel 10. Depending on the precision in which this obstruction can be controlled, carburetor C can be operated using any of a wide variety of fuel types in fuel source 20.

Figure 2A:
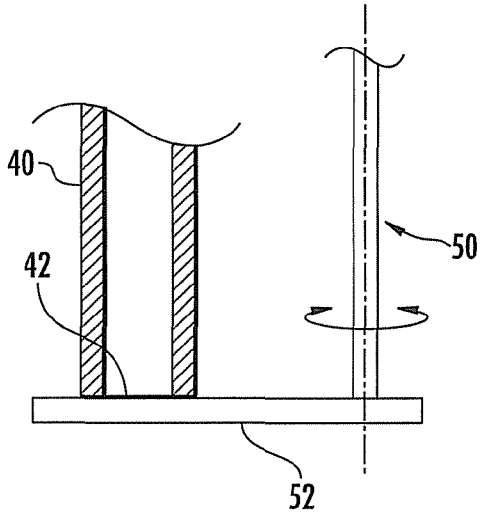
FIGS. 2A, 2B, and 2C are partial sectional views illustrating multiple positions of a fuel control device relative to an inlet of a fuel nozzle according to an embodiment of the presently disclosed subject matter.
Figure 2B:
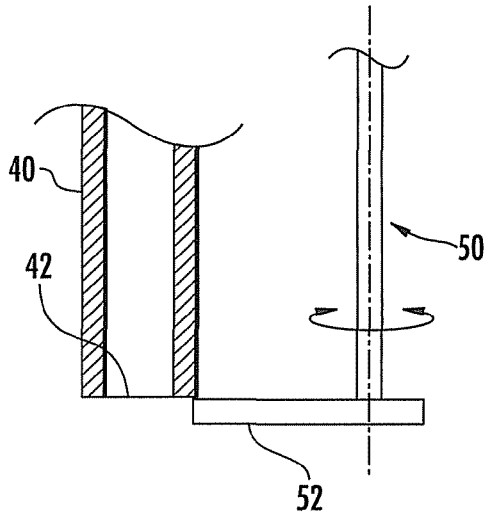
Figure 2C:
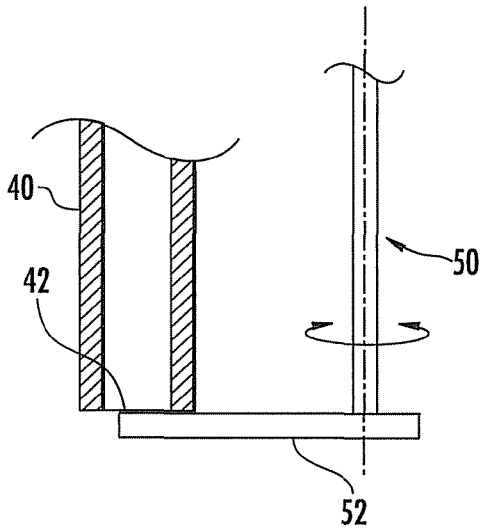

In this regard, fuel control device 50 can be used to control the amount of fuel that is permitted to flow through second fuel nozzle 40 to carburetor barrel 10. In one aspect and as is shown in FIGS. 2A through 2C, fuel control device 50 can include a regulating portion 52 at one end, regulating portion 52 being movable with respect to second fuel nozzle 40 to selectively block all, none, or at least a portion of second inlet 42. In particular, regulating portion 52 of fuel control device 50 can be selectively movable between a closed position in which second inlet 42 of second fuel nozzle 40 is completely blocked (See, e.g., FIG. 2A) and an open position in which second inlet 42 is completely unobstructed (See, e.g., FIG. 2B).

Figure 3A:
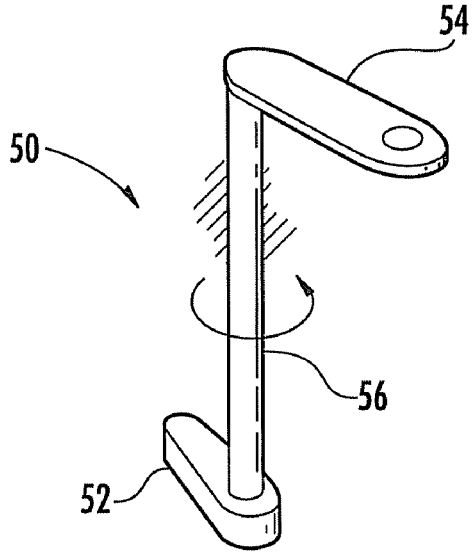
FIG. 3A is a perspective view of a fuel control device according to one embodiment of the presently disclosed subject matter.

For instance, in one exemplary embodiment depicted in FIG. 3A, regulating portion 52 can simply be a plate mounted on the end of fuel control device 50. In this embodiment, regulating portion 52 (i.e., the plate) can be rotated between the closed position and the open position. Rotation of regulating portion 52 can be controlled by a fuel control handle 54 that can be easily accessible to an operator, either directly or indirectly. A rod, cable, or other form of mechanical linkage, generally designated 56, can connect fuel control handle 54 to regulating portion 52 for controlling rotation. In this arrangement, an operator can rotate fuel control handle 54 to correspondingly rotate regulating portion 52 between the closed position and the open position and thereby adjust the fuel delivery from second fuel nozzle 40 to provide the proper air/fuel ratio for the fuel type contained in fuel source 20.

Figure 3B:
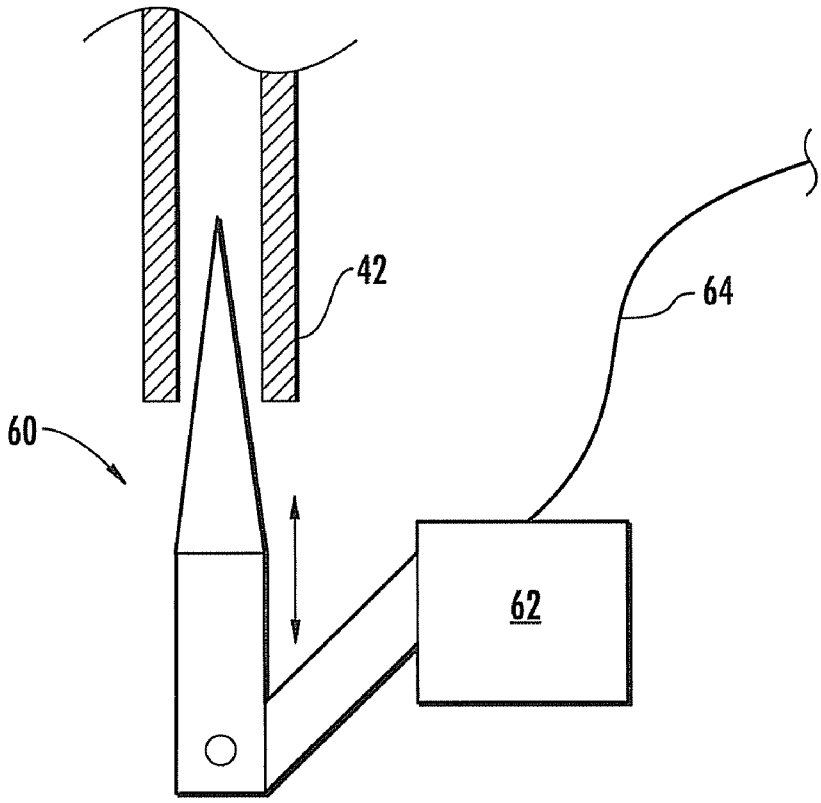
FIG. 3B is a perspective view of a fuel control device according to another embodiment of the presently disclosed subject matter.

Alternatively, as is shown in FIG. 3B, the regulating portion can be a valve, such as a metering or needle valve, generally designated 60, that regulates the size of second inlet 42 of second fuel nozzle 40. Needle valve 60 can be moved between a closed position (i.e., valve closed) and an open position (i.e., valve open), but rather than having a rotating fuel control handle 54 and rod 56 to cause the motion of the regulating portion as in FIG. 3A, a cable-controlled or electrically-operated actuator 62 can be remotely triggered (e.g., using a cable 64) to cause the motion of needle valve 60. Regardless of the specific mechanism by which the motion of the regulating portion (e.g, regulating portion 52 or needle valve 60) is accomplished, though, an operator of the engine can easily control the position of fuel control device 50 and thereby control the air/fuel ratio in carburetor barrel 10.

In addition, as noted above, carburetor C can be designed to allow adjustments to the air/fuel ratio to values between the maximum (first fuel nozzle alone) and the minimum (both first and second fuel nozzles) ratios. These intermediate mixtures can be created by fuel control device 50 being movable to at least one intermediate position between the open position and the closed position. For instance, and with respect to the regulating portion shown as regulating portion 52 with a rotatable plate, fuel control device 50 can be operated so that regulating portion 52 is positioned to only partially obstruct second inlet 42 of second fuel nozzle 40 as is shown in FIG. 2C. Likewise, for embodiments in which the regulating portion comprises a valve, such as needle valve 60, the intermediate state can be achieved by moving the valve to a partially open position.

In either configuration, movement of fuel control device 50 to an intermediate position provides more fuel to carburetor barrel 10 than is provided by first fuel nozzle 30 alone, but less fuel than is provided by the first and second fuel nozzles 30 and 40 together when fuel control device 50 is in an open position. For example, if first fuel nozzle 30 is sized to provide the proper air/fuel ratio for gasoline, and second fuel nozzle 40 is sized such that the combination of first and second fuel nozzles 30 and 40 produces an air/fuel ratio for pure ethanol, moving fuel control device 50 to an intermediate position can be advantageous to achieve the proper air/fuel ratio for a variety of ethanol blends (e.g., E20, E85) or any of a variety of other fuel types. As a result, the use of carburetor C according to the presently disclosed subject matter can allow an internal combustion engine to be operated using a wide variety of fuel types without requiring any substantial modifications to the engine or carburetor.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A multi-fuel carburetor for a combustion engine, comprising:

a fuel source;

a carburetor barrel;

a first fuel nozzle having a first inlet at and communicating with the fuel source and a first outlet at and communicating with the carburetor barrel;

a second fuel nozzle having a second inlet at and communicating with the fuel source and a second outlet at and communicating with the carburetor barrel; and a fuel control device movable with respect to the second fuel nozzle between a closed position in which the second fuel nozzle is blocked and an open position in which the second fuel nozzle is unobstructed.

2. The carburetor of claim 1, wherein the fuel control device is further movable to at least one intermediate position between the open position and the closed position in which the second fuel nozzle is partially obstructed by the fuel control device.

3. The carburetor of claim 1, wherein the first fuel nozzle is sized to provide an amount of fuel to the carburetor barrel for producing an air/fuel ratio in the carburetor barrel for the combustion of a first fuel type.

4. The carburetor of claim 3, wherein the first fuel nozzle is sized to provide an amount of fuel to the carburetor barrel for producing an air/fuel ratio in the carburetor barrel of about 14.6 to 1 for the combustion of gasoline.

5. The carburetor of claim 3, wherein the second fuel nozzle is sized such that the combination, of the first fuel nozzle and the second fuel nozzle provide an amount of fuel to the carburetor barrel for producing an air/fuel ratio in the carburetor barrel for the combustion of a second fuel type.

6. The carburetor of claim 1, wherein the fuel control device comprises a plate movable to at least partially obstruct the second inlet of the second fuel nozzle.

7. The carburetor of claim 6, comprising an operator input device connected to the plate for movement of the plate.

8. The carburetor of claim 7, wherein the operator input device comprises a rotatable rod.

9. The carburetor of claim 8, wherein the rotatable rod extends away from and out of the fuel source.

10. A multi-fuel carburetor for a combustion engine, comprising:

a fuel source;

a carburetor barrel;

a first fuel nozzle having a first inlet at and communicating with the fuel source and a first outlet at and communicating with the carburetor barrel, the first fuel nozzle being sized to provide an amount of fuel to the carburetor barrel for producing an air/fuel ratio in the carburetor barrel for the combustion of a first fuel type;

a second fuel nozzle having a second inlet at and communicating with the fuel source and a second outlet at and communicating with the carburetor barrel, the second fuel nozzle being sized such that the combination of the first fuel nozzle and the second fuel nozzle provide an amount of fuel to the, carburetor barrel for producing an air/fuel ratio in the carburetor barrel for the combustion of a second fuel type;

a fuel control device movable with respect to the second fuel nozzle, the fuel control device comprising a plate movable between a closed position in which the second inlet of second fuel nozzle is blocked and an open position in which the second inlet of second fuel nozzle is unobstructed; and a control rod connected to the fuel control device, wherein rotation of the control rod moves the plate between the closed position and the open position.

11. A method for providing fuel to a multi-fuel carburetor for a combustion engine, comprising:

supplying fuel from a fuel source through a first inlet at and communicating with the fuel source to a first fuel nozzle and into a carburetor barrel from a first fuel outlet at and communicating with the carburetor barrel;

supplying fuel from the fuel source through a second inlet at and communicating with the fuel source to a second fuel nozzle and into the carburetor barrel from a second outlet at and communicating with the carburetor barrel; and moving a fuel control device with respect to the second fuel nozzle between a closed position in which the second fuel nozzle is blocked and an open position in which the second fuel nozzle is unobstructed.

12. The method of claim 11, wherein supplying fuel from a fuel source through a first fuel nozzle comprises supplying an amount of fuel to the carburetor barrel for producing an air/fuel ratio in the carburetor barrel for the combustion of a first fuel type.

13. The method of claim 12, wherein supplying an amount of fuel to the carburetor comprises supplying an amount of fuel for producing an air/fuel ratio in the carburetor barrel of about 14.6 to 1 for the combustion of gasoline.

14. The method of claim 11, wherein supplying fuel from a fuel source through a second fuel nozzle comprises supplying an amount of fuel from the combination of the first fuel nozzle and the second fuel nozzle to the carburetor barrel for producing an air/fuel ratio in the carburetor barrel for the combustion of a second fuel type.

15. The method of claim 11, wherein moving the fuel control device comprises moving a plate to at least partially obstruct the second inlet of the second fuel nozzle.

16. The method of claim 15, wherein moving the plate comprises moving the plate in response to input from an operator.

17. The method of claim 16, wherein the input from an operator comprises moving a rotatable rod connected to the plate.

18. The method of claim 11, comprising moving the fuel control device to at least one intermediate position between the open position and the closed position in which the second fuel nozzle is partially obstructed by the fuel control device.

* * * * *